US007465237B1

(12) United States Patent
Shoemaker

(10) Patent No.: US 7,465,237 B1
(45) Date of Patent: Dec. 16, 2008

(54) MAGNETIC GOLF PUTTING TRAINING DEVICE

(76) Inventor: Robert H. Shoemaker, 768 Fern Dr., Longwood, FL (US) 32779

( * ) Notice: Subject to any disclaimer, the term of this patent is extended or adjusted under 35 U.S.C. 154(b) by 0 days.

(21) Appl. No.: 12/112,277

(22) Filed: Apr. 30, 2008

(51) Int. Cl.
*A63B 69/36* (2006.01)

(52) U.S. Cl. ..... 473/265; 473/219; 473/226

(58) Field of Classification Search ..... 473/150, 473/151, 159, 168, 219, 221, 222, 223, 225, 473/226, 257, 261, 262, 264, 265, 266, 278
See application file for complete search history.

(56) References Cited

U.S. PATENT DOCUMENTS 1,644,392 A 10/1927 Myers
2,340,793 A 2/1944 Chapman
4,017,082 A 4/1977 Channing et al.
5,435,547 A * 7/1995 Lee ..... 473/225
5,826,874 A * 10/1998 Teitell et al. ..... 473/225
6,241,621 B1 6/2001 Maher
6,503,152 B1 1/2003 Pelz
6,709,343 B1 3/2004 O'Connor et al.
6,769,995 B1 8/2004 Rhodes et al.
7,201,667 B2 4/2007 Dorman

* cited by examiner

*Primary Examiner*—Nini Legesse
(74) *Attorney, Agent, or Firm*—The Livingston Firm; Edward M. Livingston; Angela M. Miller

(57) ABSTRACT

A magnetic golf putting training device (1) having an attachment device (10) with two arms (3*a* and 3*b*), a clamp (25) for removably attaching the attachment device (10) to a putter (2), magnets (11*a* and 11*b*) located on the arms (3*a* and 3*b*) and guiding magnets (12*a* and 12*b*). The arms (3*a* and 3*b*) are located on each end of the putter head (9) during use. The guiding magnets (12*a* and 12*b*) are positioned such that they are substantially perpendicular to the putter head (9) and such that the electromagnetic field of each guiding magnets (12*a* and 12*b*) is facing towards the like electromagnetic field of each magnet (11*a* and 11*b*) located on the arms (3*a* and 3*b*) so as to create a repelling force (28).

23 Claims, 3 Drawing Sheets

MAGNETIC GOLF PUTTING TRAINING DEVICE

BACKGROUND OF THE INVENTION

This invention relates to golf putter training devices, more particularly, a magnetic golf putting training device that utilizes repulsive magnetic forces to train a user to properly align a putter head and stroke.

In golf, successful putting is truly an art form as a golfer must be certain that proper positioning is maintained at all times. For instance, the golfer must make certain that he/she is properly holding the golf putter, that his/her body is in proper alignment in relation to the putter and the hole and the alignment of the face of the putter head is square to the golf ball. In addition, even if all of the above positions are proper, the golfer must exert just the right amount of force on the golf ball so as to sink the putt.

Because a golfer must be cognizant of his/her positioning at all times, it is easy for a golfer to "overthink" his/her positioning, thereby preventing him/her to learn how to put in a natural, fluid manner. Rather, the overthinking leads to short, choppy putts, which does not readily promote the smooth, graceful and accurate putting which is ultimately desired.

Although there are currently putting training devices that include visual indicators to permit a user to monitor his/her positioning and follow through on the putt, these visual indicators distract the user from learning proper technique as the user is more focused on looking at the training aid as opposed to feeling and learning the proper putting technique.

Rather, a better method for training a user to properly putt is by permitting the user to concentrate on the motion of the putt itself, thereby allowing his/her body to become accustomed to the proper putting positioning and follow through.

Thus, a need exists for a magnetic golf putting training device that utilizes repulsive magnetic forces to train a user to properly align a putter head and stroke.

The relevant prior art includes the following references:

| U.S. Pat. No. (U.S. unless stated otherwise) | Inventor | Issue/Publication Date |
|---|---|---|
| 6,769,995 | Rhodes et al. | Aug. 03, 2004 |
| 4,017,082 | Channing et al. | Apr. 12, 1977 |
| 7,201,667 | Dorman | Apr. 10, 2007 |
| 6,503,152 | Pelz | Jan. 07, 2003 |
| 5,435,547 | Lee | Jul. 25, 1995 |
| 6,241,621 | Maher | Jun. 05, 2001 |
| 6,709,343 | O'Connor et al. | Mar. 23, 2004 |
| 2,340,793 | Chapman | Feb. 01, 1944 |
| 1,644,392 | Myers | Oct. 04, 1927 |

SUMMARY OF THE INVENTION

The primary object of the present invention is to provide a magnetic golf putting training device that utilizes repulsive magnetic forces to train a user to properly align a putter head and stroke.

A further object of the present invention is to provide a magnetic golf putting training device that retroactively fits existing golf putters.

An even further object of the present invention is to provide a magnetic golf putting training device that is easy to use.

Another object of the present invention is to provide a magnetic golf putting training device that may be used in conjunction with a practice mat or on a golf course.

The present invention fulfills the above and other objects by providing a magnetic golf putting training device having a golf putter with a putter head, an attachment device with at least one arm, an attachment means for removably attaching the attachment device to a golf putter, at least one magnet located on said at least one arm, said at least one magnet having a first electromagnetic field and a second electromagnetic field and at least one guiding magnet having a first magnetic field equal to said first electromagnetic field of said at least one magnet located on said at least one arm and a second electromagnetic field equal to said second electromagnetic field of said at least one magnet located on said at least one arm, said at least one guiding magnet is substantially perpendicular to said putter head when positioned for use wherein when said at least one magnet on said at least one arm is positioned such that said first electromagnetic field is disposed towards said first magnetic field on said at least one guiding magnet so as to create a repelling force.

To use the present invention, a user first secures the attachment device to a golf putter such that the arms of the device are located on each end of a golf putter head. Then, the user positions the guiding magnets such that the first magnetic field of each guiding magnet are facing towards the first magnetic field of each magnet located on the arms so as to create a repelling force. The user then places the putter head between the guiding magnets such that the putter head is substantially perpendicular to the guiding magnets and putts. Thus, when a user swings the putter, the repelling force maintains the putter head within a predetermined area between the guiding magnets and keeps the putter head in a straight line between the guiding magnets during the stroke. In the alternative, the magnets on the arms and the guiding magnets may be positioned such that the second magnetic fields are facing towards one another so as to create a repelling force.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 4:
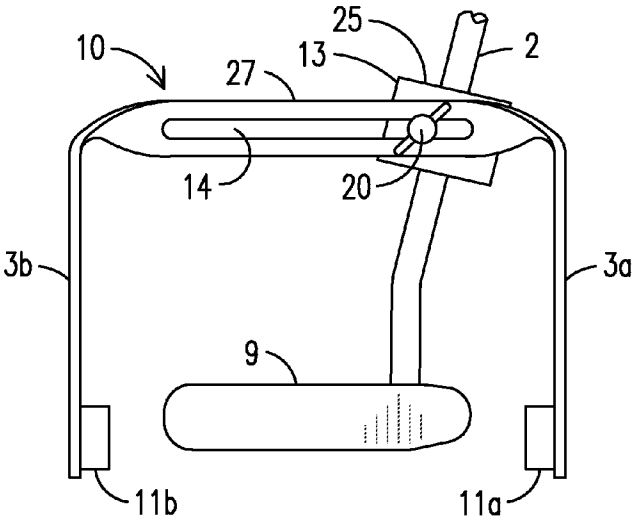
FIG. 4 is a front view of the attachment device of the magnetic golf putting training device of the present invention installed on a golf putter.

For purposes of describing the preferred embodiment, the terminology used in reference to the numbered components in the drawings is as follows:

| | |
|---|---|
| 1. | magnetic golf putting training device, generally |
| 2. | putter |
| 3a. | first arm |
| 3b. | second arm |
| 4. | holder |
| 5. | planar surface |
| 6. | ground surface |
| 7. | hole |
| 8. | ramp |
| 9. | putter head |
| 10. | attachment device, generally |
| 11a. | first magnet |
| 11b. | second magnet |
| 12a. | first guiding magnet |
| 12b. | second guiding magnet |
| 13. | attachment means |
| 14. | slot |
| 15. | first electromagnetic field |
| 16. | second electromagnetic field |
| 17. | leg |
| 18. | retaining member |
| 19. | aperture |
| 20. | wing nut |
| 21. | base member |
| 22. | leg magnet |
| 23. | lag hole |
| 24. | hook and loop fastening means |
| 25. | clamp |
| 26. | spike |
| 27. | horizontal member |
| 28. | repelling force |
| 29. | putting area |
| 30. | top surface |
| 31. | bottom surface |
| 32. | bolt |
| 33. | fastening means |

Figure 1:
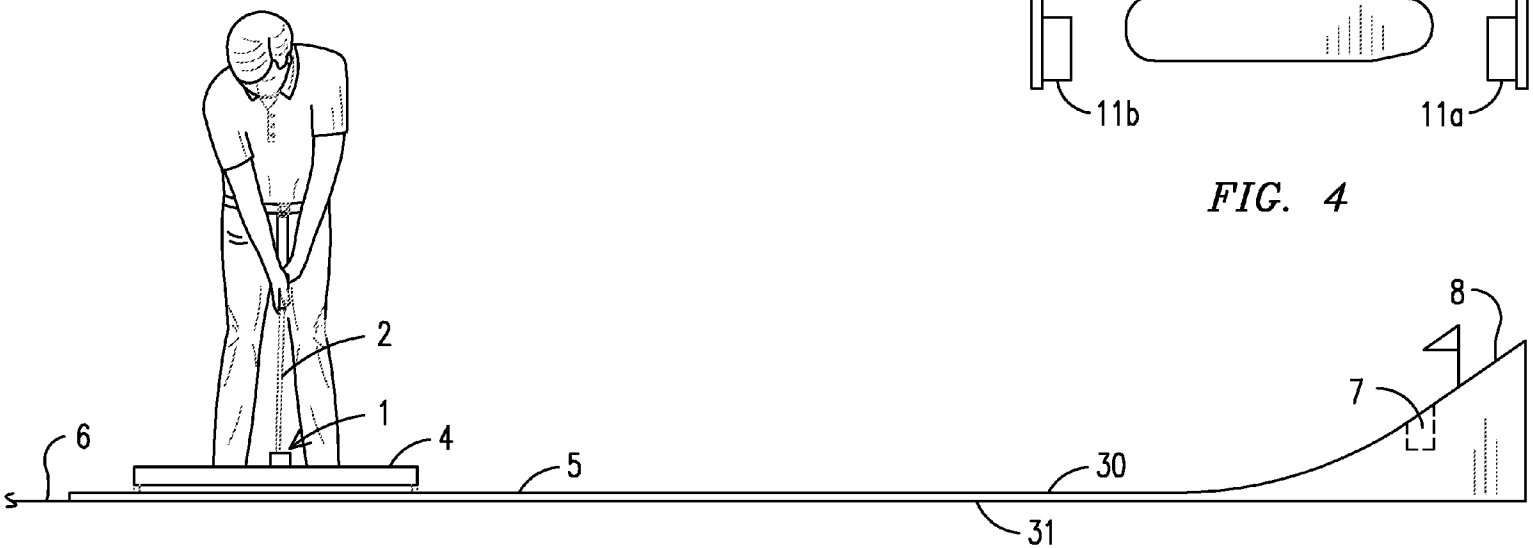
FIG. 1 is a side view of a magnetic golf putting training device of the present invention in use.

With reference to FIG. 1, a side view of a magnetic golf putting training device of the present invention in use is shown. The magnetic golf putting training device, generally 1 preferably has at least one arm 3*a*, is permanently or removably secured to a putter 2 and is preferably used in conjunction with a holder 4 and a planar surface 5, such as a mat, having a top surface 30 and a bottom surface 31 wherein the bottom surface 31 is located on a ground surface 6. The planar surface 5 may include a ramp 8 and a hole 7 to simulate a hole at a golf course.

Figure 2:
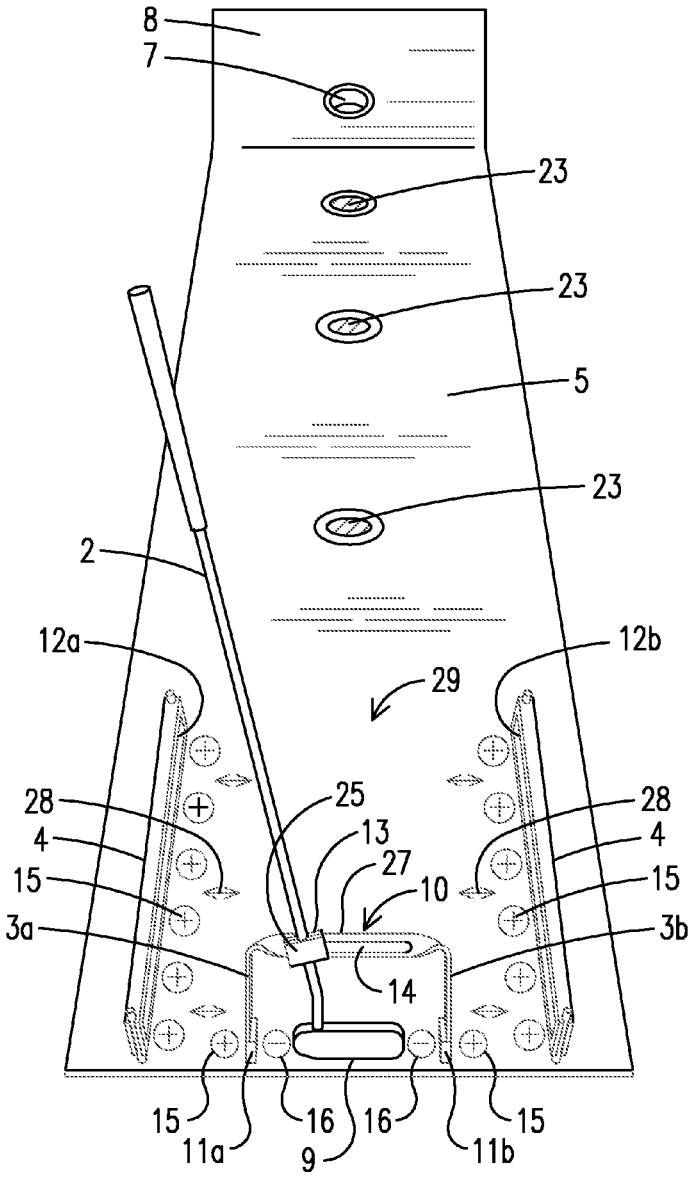
FIG. 2 is a top perspective view of the magnetic golf putting training device of the present invention.

FIG. 2 shows a top perspective view of the magnetic golf putting training device of the present invention. The golf putting training device 1 includes an attachment device 10 and at least one guiding magnet 12*a* and 12*b*. The attachment device 10 includes at least one arm 3*a* having at least one magnet 11*a* attached thereto. However, the preferred embodiment includes the attachment device 10 having a first arm 3*a* and a second arm 3*b* with a first magnet 11*a* attached to the first arm 3*a* and a second magnet 11*b* attached to the second arm 3*b*. A horizontal member 27 is preferably located between the first arm 3*a* and the second arm 3*b* and is securable to the golf putter 2 via at least one attachment means 13, which is preferably a clamp 25. The arms 3*a* and 3*b* preferably extend perpendicularly from the horizontal member 27 so as to be located on each end of the putter head 9 when the attachment device 10 is secured to the putter 2. The horizontal member 27 may also include at least one slot 14 to permit a user to adjustably secure the attachment device 10 to the putter 2.

A first guiding magnet 12*a* and a second guiding magnet 12*b* are positioned on the planar surface 5 so as to extend towards the hole 7. The guiding magnets 12*a* and 12*b* are also positioned so as to be parallel to one another to create a putting area 29 wherein the putter 2 with attachment device 10 is located therein during use. The guiding magnets 12*a* and 12*b* preferably include a fastening means 33 to secure the guiding magnets 12*a* and 12*b* in a predetermined position on the planar surface 5 or, in the alternative, on a ground surface 6.

As is commonly known, each magnet 11*a*, 11*b*, 12*a* and 12*b* has a first electromagnetic field 15, such as a positive electromagnetic field or a North pole, and a second electromagnetic field 16, such as a negative electromagnetic field or a South pole. As is also commonly known, when two dissimilar electromagnetic fields are located adjacent to one another, an attractant force is created. On the other hand, when similar electromagnetic fields are adjacent to one another, a repelling force 28 is created. Thus, if two first electromagnetic fields 15 or two second electromagnetic fields 16 are adjacent to one another, a repelling force 28 is created wherein the electromagnetic fields 15 or 16 push away or repel one another.

Using this phenomenon, the guiding magnets 12*a* and 12*b* are positioned such that the first electromagnetic fields 15 of the guiding magnets 12*a* and 12*b* are facing towards the first electromagnetic fields 15 of the magnets 11*a* and 11*b* to create a repelling force 28. This repelling force 28 maintains the putter head 9 within a predetermined area between the guiding magnets 12*a* and 12*b* so as to encourage proper putting.

During use of the present invention, the guiding magnets 12*a* and 12*b* are positioned such that they are substantially perpendicular to the putter head 9. The guiding magnets 12*a* and 12*b* may be located on holders 4 which extend a predetermined distance above the planar surface 5. In this manner, even if the user exerts enough force on the putter 2 so as to overcome the repulsive force 28, he/she will be prevented from extending the putter head 9 outside of the confines of the putting area 29.

Furthermore, the guiding magnets 12*a* and 12*b* may be of any type of magnet, including, but not limited to, bar magnets, round magnets, a series of magnets and the like.

Optional lag holes 23 may be located on the planar surface 5 so as to further aid in training a user to putt as to the speed of a putter stroke. In addition, although the planar surface 5 is shown having a ramp 8 and a hole 7, the planar surface 5 may not include a ramp 8 and, rather than having an actual hole 7, may include a simulated hole 7 that is painted or otherwise marked on the planar surface 5.

Figure 3:
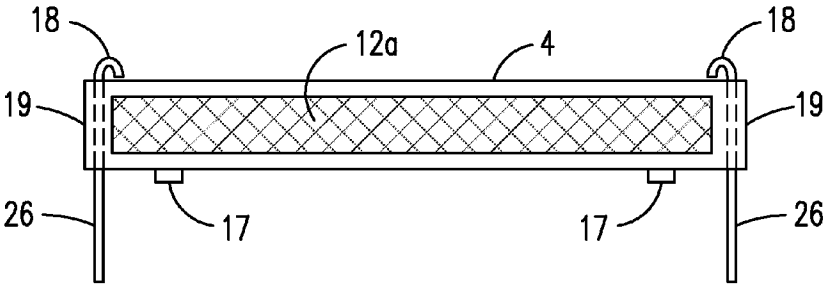
FIG. 3 is a side plan view of a guiding magnet secured to a holder of the golf putting training device of the present invention.

Next, FIG. 3 shows a side plan view of a guiding magnet secured to a holder of the golf putting training device of the present invention. The holder 4 is preferably made of a metal material so as to permit the guiding magnet 12*a* to adhere thereto; however, the holder 4 may be constructed of any material.

Figure 6:
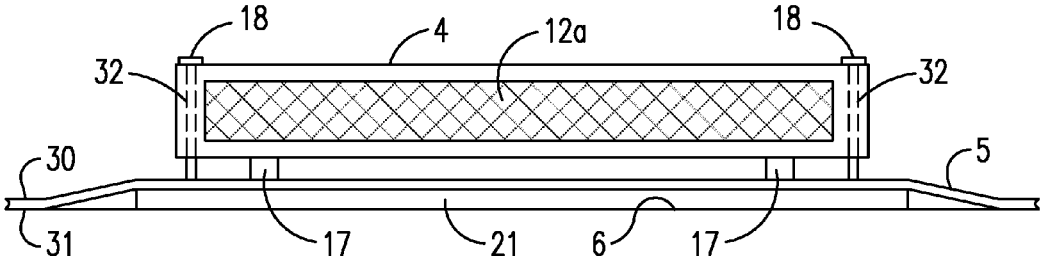
FIG. 6 is a side view of a holder of the golf putting training device of the present invention secured to a base member.

Preferably located on the holder 4 is at least one aperture 19 to permit a retaining member 18, such as a spike 26 or bolt 32 (as shown in FIG. 6), to be inserted therethrough. The retaining member 18 permits a user to secure the holder 4, and thus guiding magnet 12*a*, in a predetermined location, such as on a planar surface 5 or into a ground surface 6, such as on a golf course.

Optional legs 17 may be located on the holder 4 to elevate the holder 4 a predetermined distance above the planar surface 5 or ground surface 6 so as to create a space therebetween.

Figure 5:
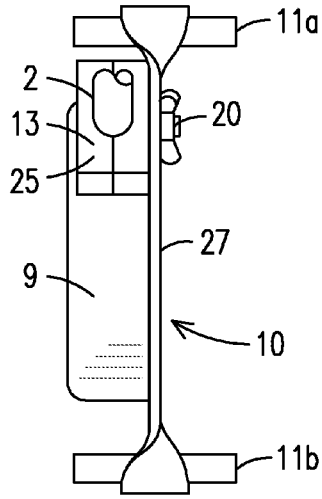
FIG. 5 is a top view of the embodiment of FIG. 4.

With respect to FIGS. 4 and 5, varying views of the attachment device of the magnetic golf putting training device of the present invention installed on a golf putter are shown. The attachment device 10 preferably includes a first arm 3*a* and a second arm 3*b* and a horizontal member 27 located therebetween. The arms 3*a* and 3*b* preferably extend in a perpendicular manner from the horizontal member 27 and terminate adjacent to the putter head 9. The arms 3*a* and 3*b* are located preferably on both ends of the putter head 9 so as to encompass the putter head 9.

The attachment device 10 preferably includes an attachment means 13, such as a clamp 25 having a bolt 32 and wingnut 20. The attachment device 10 is preferably removably secured to the golf putter 2 via the attachment means 13. In addition, the attachment device 10 is preferably adjustably secured to the golf putter 2 by sliding the bolt 32 along the slot 14 to a desired position.

FIG. 6 shows a side view of a holder of the golf putting training device of the present invention secured to a base member. At least one retaining member 18, such as at least one bolt 32, preferably extends through the holder 4 and planar surface 5 and into a base member 21 so as to retain the holder 4 in a predetermined position on the planar surface 5. The base member 21 may be made of any material, including, but not limited to, plastic, wood and metal.

Figure 7:
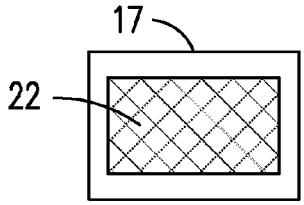
FIG. 7 is a bottom view of a leg of a holder of the golf putting training device of the present invention.

Next, FIG. 7 shows a bottom view of a leg of a holder of the golf putting training device of the present invention. The leg 17 may include at least one leg magnet 22 to permit a user to secure the holder 4 to the base member 21 if the base member 21 is made of metal. In this manner, a user is able to quickly and easily set up the golf putting training device 1 of the present invention without the use of at least one retaining member 18.

Figure 9:
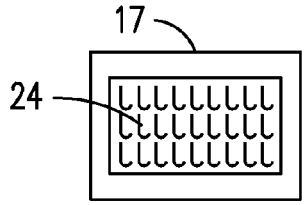
FIG. 9 is a bottom view of a leg of a holder having a hook and loop type fastening means.
Figure 8:
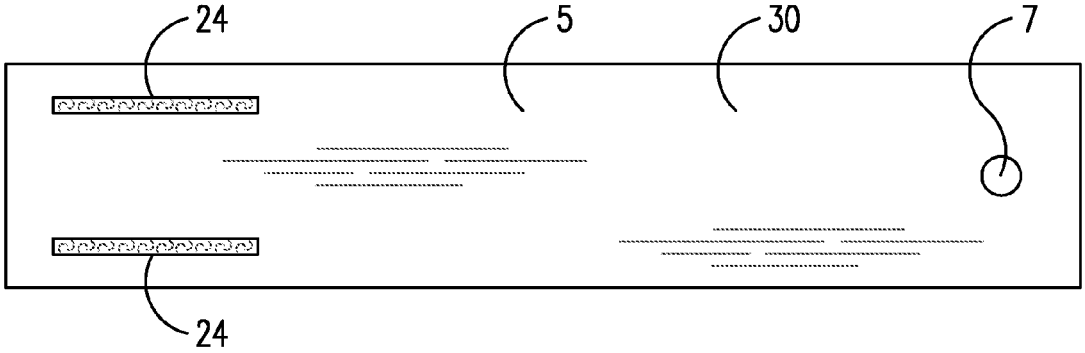
FIG. 8 is a top view of a planar surface of the golf putting training device of the present invention.

With reference to FIG. 8, a top view of a planar surface of the golf putting training device of the present invention is shown. The planar surface 5 may include hook and loop fastening means 24 located on the putting area 29 for securement of the guiding magnets 12*a* and 12*b* when the guiding magnets 12*a* and 12*b* have corresponding hook and loop fastening means 24 located thereon (not shown), securement of the holders 4 when corresponding hook and loop fastening means 24 are located thereon (not shown) or securement of the legs 17 of the holders 4 when corresponding hook and loop fastening means 24 are located thereon as shown in FIG. 9.

Figure 10:
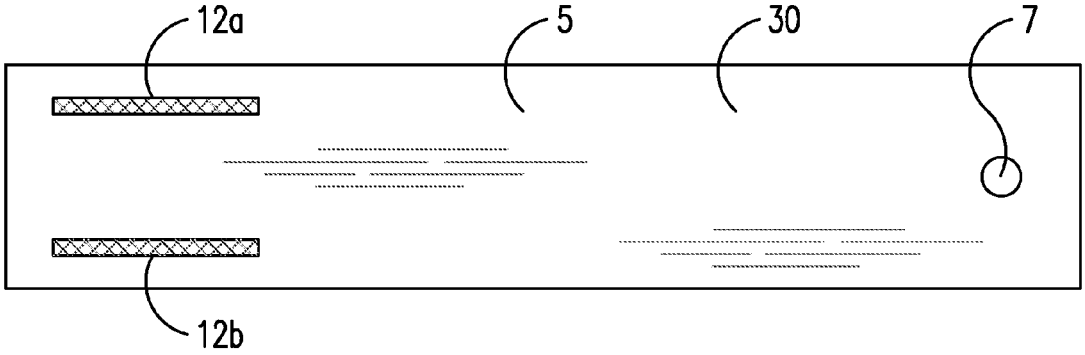
FIG. 10 is a top view of a planar surface having guiding magnets located directly thereon of the golf putting training device of the present invention.

FIG. 10 shows a top view of a planar surface having guiding magnets located directly thereon of the golf putting training device of the present invention. Rather than having the guiding magnets 12*a* and 12*b* secured to a holder 4 wherein the holders 4 are secured to the planar surface 5, the guiding magnets 12*a* and 12*b* may be directly secured to or placed on top of the planar surface 5.

In the alternative, the guiding magnets 12*a* and 12*b* may be directly secured to or placed on top of a ground surface 6, such as a golf course (not shown).

Figure 11:
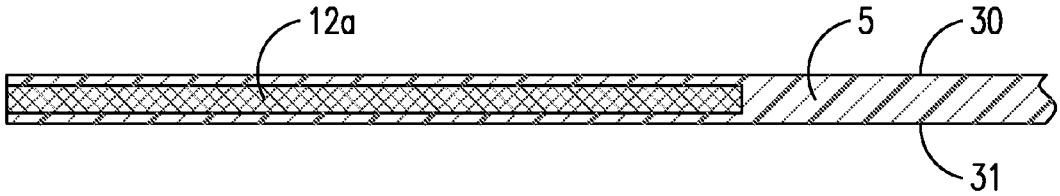
FIG. 11 is a side plan view of a planar surface of the golf putting training device of the present invention having at least one guiding magnet located therein.

Finally, FIG. 11 shows a side plan view of a planar surface of the golf putting training device of the present invention having at least one guiding magnet located therein. The planar surface 5 includes a top surface 30 and a bottom surface 31 wherein at least one guiding magnet 12*a* is located between the top surface 30 and the bottom surface 31.

The use of the present invention will teach a person to properly align a putter head and stroke.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A magnetic golf putting training device comprising:

a golf putter having a putter head;

at least one attachment device having at least one arm;

at least one attachment means for removably attaching said at least one attachment device to said golf putter;

at least one magnet located on said at least one arm;

said at least one magnet having a first electromagnetic field and a second electromagnetic field; and at least one guiding magnet having a first magnetic field equal to said first electromagnetic field of said at least one magnet located on said at least one arm and a second electromagnetic field equal to said second electromagnetic field of said at least one magnet located on said at least one arm;

said at least one guiding magnet is substantially perpendicular to said putter head when positioned for use;

wherein when said at least one magnet on said at least one arm is positioned such that said first electromagnetic field is disposed towards said first magnetic field on said at least one guiding magnet a repelling force is created.

2. The magnetic golf putting training device of claim 1 wherein:

said at least one attachment means is at least one clamp.

3. The magnetic golf putting training device of claim 2 wherein:

said at least one clamp is adjustably attached to said at least one attachment device.

4. The magnetic golf putting training device of claim 3 wherein:

said at least one arm is substantially perpendicular to a ground surface.

5. The magnetic golf putting training device of claim 1 wherein:

said at least one arm is substantially perpendicular to a ground surface.

6. The magnetic golf putting training device of claim 1 further comprising:

at least one means for fastening said at least one guiding magnet in a predetermined position.

7. The magnetic golf putting training device of claim 6 wherein:

said at least one means for fastening is at least one holder;

said at least one guiding magnet is secured to said at least one holder;

said at least one holder having at least one aperture; and at least one retaining member sized for insertion into said at least one aperture and into a ground surface.

8. The magnetic golf putting training device of claim 7 wherein:

said at least one retaining member is at least one spike.

9. The magnetic golf putting training device of claim 8 further comprising:

at least one leg located on said at least one holder.

10. The magnetic golf putting training device of claim 7 further comprising:

at least one leg located on said at least one holder.

11. The magnetic golf putting training device of claim 6 further comprising:

at least one substantially planar surface having a top surface and a bottom surface wherein said at least one guiding magnet is positioned on said top surface.

12. The magnetic golf putting training device of claim 11 wherein:

said at least one means for fastening is at least one holder;

said at least one guiding magnet is secured to said at least one holder;

said at least one holder having at least one hook and loop type fastening means; and at least one corresponding hook and loop type fastening means located on said mat top surface.

13. The magnetic golf putting training device of claim 12 further comprising:

at least one leg located on said at least one holder.

14. A magnetic golf putting training device of claim 11 further comprising:

at least one designation for a hole located on said at least one substantially planar surface top surface.

15. The magnetic golf putting training device of claim 6 further comprising:

at least one substantially planar surface having a top surface and a bottom surface wherein said at least one guiding magnet is located between said top surface and said bottom surface.

16. A magnetic golf putting training device comprising:

a golf putter having a putter head;

at least one attachment device having at least one arm;

at least one attachment means for removably attaching said at least one attachment device to said golf putter;

at least one magnet located on said at least one arm;

said at least one magnet having a first electromagnetic field and a second electromagnetic field; and at least one guiding magnet having a first magnetic field equal to said first electromagnetic field of said at least one magnet located on said at least one arm and a second electromagnetic field equal to said second electromagnetic field of said at least one magnet located on said at least one arm;

said at least one guiding magnet is substantially perpendicular to said putter head when positioned for use;

at least one means for fastening said at least one guiding magnet in a predetermined position;

wherein when said at least one magnet on said at least one arm is positioned such that said first electromagnetic field is disposed towards said first magnetic field on said at least one guiding magnet so as to create a repelling force.

17. The magnetic golf putting training device of claim 16 further comprising:

at least one means for fastening said at least one guiding magnet in a predetermined position.

18. The magnetic golf putting training device of claim 17 wherein:

said at least one means for fastening is at least one holder;

said at least one guiding magnet is secured to said at least one holder;

said at least one holder having at least one aperture; and at least one retaining member sized for insertion into said at least one aperture and into a base member.

19. The magnetic golf putting training device of claim 16 further comprising:

at least one substantially planar surface having a top surface and a bottom surface wherein said at least one guiding magnet is positioned on said top surface.

20. A magnetic golf putting training device of claim 19 further comprising:

at least one designation for a hole located on said at least one substantially planar surface top surface.

21. The magnetic golf putting training device of claim 16 further comprising:

at least one substantially planar surface having a top surface and a bottom surface wherein said at least one guiding magnet is located between said top surface and said bottom surface.

22. A magnetic golf putting training device of claim 21 further comprising:

at least one designation for a hole located on said at least one substantially planar surface top surface.

23. A magnetic golf putting training device comprising:

a golf putter having a putter head;

at least one attachment device having a horizontal member, a first arm and a second arm;

said horizontal member is located between said first arm and said second arm;

said first arm is parallel to said second arm;

said at least one attachment device is attached to said golf putter;

a first magnet located on said first arm;

a second magnet located on said second arm;

said first magnet having a first electromagnetic field and a second electromagnetic field;

said second magnet having a first electromagnetic field and a second electromagnetic field;

a first guiding magnet having a first magnetic field equal to said first electromagnetic field of said first magnet located on said first arm and a second electromagnetic field equal to said second electromagnetic field of said first magnet located on said first arm;

a second guiding magnet having a first magnetic field equal to said first electromagnetic field of said second magnet located on said second arm and a second electromagnetic field equal to said second electromagnetic field of said second magnet located on said second one arm;

at least one substantially planar surface having a top surface and a bottom surface wherein said first guiding magnet is positioned on said top surface;

at least one substantially planar surface having a top surface and a bottom surface wherein said second guiding magnet is positioned on said top surface;

at least one means for fastening said first guiding magnet in a predetermined position on said at least one substantially planar top surface;

at least one means for fastening said second guiding magnet in a predetermined position on said at least one substantially planar top surface;

wherein said first guiding magnet and said second guiding magnet are parallel to one another when fastened on said at least one substantially planar top surface so as to create a putting area;

said first guiding magnet is substantially perpendicular to said putter head when positioned for use;

said second guiding magnet is substantially perpendicular to said putter head when positioned for use;

wherein when said first magnet on said first arm is positioned such that said first electromagnetic field is disposed towards said first magnetic field on said first guiding magnet so as to create a repelling force;

wherein when said second magnet on said second arm is positioned such that said first electromagnetic field is disposed towards said first magnetic field on said second guiding magnet so as to create a repelling force; and at least one designation for a hole located on said at least one substantially planar surface top surface.

* * * * *